US010410817B2

(12) United States Patent
Von Allmen

(10) Patent No.: US 10,410,817 B2
(45) Date of Patent: Sep. 10, 2019

(54) ACTUATOR CIRCUIT FOR CONTROL OF CIRCUIT BREAKER

(71) Applicant: ALSTOM TECHNOLOGY LTD, Baden (CH)

(72) Inventor: Peter Von Allmen, Buchs (CH)

(73) Assignee: General Electric Technology gmbH, Baden (CH)

( * ) Notice: Subject to any disclaimer, the term of this patent is extended or adjusted under 35 U.S.C. 154(b) by 363 days.

(21) Appl. No.: 14/394,732

(22) PCT Filed: Apr. 22, 2013

(86) PCT No.: PCT/EP2013/058243

§ 371 (c)(1),
(2) Date: Oct. 15, 2014

(87) PCT Pub. No.: WO2013/160217

PCT Pub. Date: Oct. 31, 2013

(65) Prior Publication Data

US 2015/0103459 A1 Apr. 16, 2015

(30) Foreign Application Priority Data

Apr. 24, 2012 (FR) ..... 12 53758

(51) Int. Cl.
*H01H 33/59* (2006.01)
*H01H 47/00* (2006.01)
(Continued)

(52) U.S. Cl.
CPC ..... *H01H 71/1081* (2013.01); *H01H 33/59* (2013.01); *H01H 47/00* (2013.01);
(Continued)

(58) Field of Classification Search
CPC ..... H01H 33/59; H01H 47/00; H01H 47/002; H01H 47/06; H01H 71/10; H01H 71/1081
(Continued)

(56) References Cited

U.S. PATENT DOCUMENTS 3,149,244 A 9/1964 Barnes et al.
4,402,033 A * 8/1983 Mayer ..... H01H 47/32 361/187
(Continued)

FOREIGN PATENT DOCUMENTS

CN 201130853 10/2008
CN 1829027 A 9/2009
(Continued)

OTHER PUBLICATIONS

International Preliminary Examination Report in Application No. PCT/EP2013/058243 dated May 20, 2014.
(Continued)

*Primary Examiner* — Kevin J Comber
(74) *Attorney, Agent, or Firm* — Eversheds Sutherland (US) LLP

(57) ABSTRACT

The invention relates to an actuator circuit for actuating a circuit breaker controller, the circuit being characterized in that it comprises two branches in parallel between two terminals and in that the first branch includes only a first coil;

the second branch includes a second coil having impedance that is lower than the first, in series with a switch controlled by a switch circuit.

8 Claims, 2 Drawing Sheets

(51) Int. Cl.
*H01H 47/06* (2006.01)
*H01H 71/10* (2006.01)

(52) U.S. Cl.
CPC ..... *H01H 47/002* (2013.01); *H01H 47/06* (2013.01); *H01H 71/10* (2013.01)

(58) Field of Classification Search
USPC ..... 361/93.9
See application file for complete search history.

(56) References Cited

U.S. PATENT DOCUMENTS 4,422,123 A 12/1983 Tominari et al.
5,581,192 A * 12/1996 Shea ..... H01H 29/004 324/555
5,583,395 A * 12/1996 Lu ..... H05B 41/046 315/101
6,504,698 B1 * 1/2003 Durif ..... H01H 47/04 361/152
2004/0027776 A1 * 2/2004 Uotome ..... H01H 47/06 361/160
2006/0181156 A1 8/2006 Titschert et al.

FOREIGN PATENT DOCUMENTS

CN 201425922 Y 3/2010
CN 201562955 8/2010

OTHER PUBLICATIONS

International Search Report in Application No. PCT/EP2013/058243 dated Jul. 15, 2013.
Preliminary Search Report in Application No. PCT/EP2013/058243 dated Jan. 11, 2013.
International Preliminary Examination Report/Written Opinion in Application No. PCT/EP2013/058243 dated May 20, 2014.

* cited by examiner

ACTUATOR CIRCUIT FOR CONTROL OF CIRCUIT BREAKER

CROSS-REFERENCE TO RELATED PATENT APPLICATION

The present application is a National Stage Application of International Application No. PCT/EP2013/058243 entitled "ACTUATOR CIRCUIT FOR CONTROL OF CIRCUIT BREAKER" filed Apr. 22, 2013, which claims benefit of priority to French patent Application No. 12 53758 filed on Apr. 24, 2012. Both of these applications are incorporated herein by reference in their entirety.

TECHNICAL FIELD

The present invention relates to an actuator device for controlling electrical disconnection equipment, such as a medium-voltage or a high-voltage circuit breaker.

STATE OF THE PRIOR ART

A circuit breaker, e.g. in a gas-insulated substation (GIS) is fitted with a controller. That controller supplies the energy and torque necessary for moving the contacts of the circuit breaker.

Controllers may be of the hydraulic, gas-flow, or spring type. The present invention is described more particularly for a spring controller, but also applies to other types of controller.

Under the effect of an actuator mechanism, a spring controller acts mechanically in order to open or close the contacts of a circuit breaker. A conventional actuator mechanism includes a coil that drives a plunger when current passes through the coil. The plunger is connected to a ratchet mechanism in such a manner that the coil drives the mechanical operation of the spring controller by moving the plunger and consequently the ratchet mechanism.

A coil suitable for having a current passing therethrough that is capable of moving the plunger and the ratchet typically includes 1103 turns wound around a magnetic core. That means that the inductance of the coil is high, as is its time constant since it is proportional to inductance. Thus, the acting time with known solutions commonly reaches 5.5 milliseconds (ms).

This value contributes significantly to the breaking time of the circuit breaker. Since high-voltage circuit breakers in electrical networks at 60 Hertz (Hz) are often required to eliminate a fault in two cycles, their breaking time is limited to 33.3 ms. In order to reach this value, the acting time of the actuator mechanism should be limited as much as possible.

Document U.S. Pat. No. 5,889,645 relates to a controller mechanism for a gas valve in a furnace. That mechanism includes two coils for actuating the gas valve. The coils are driven by a single input signal emitted by a microprocessor and amplified by a transistor.

That implies that a failure of the microprocessor or of the transistor would prevent the control mechanism from operating. Thus, even transposing the teaching of that document for use in controlling electrical disconnection equipment, such as a circuit breaker, would not obtain a controller device that presents a satisfactory level of reliability.

Indeed, a medium-voltage or high-voltage circuit breaker is in service for a duration that typically spans 25 to 40 years. That duration is very long for an actuator circuit and in particular for components such as transistors, which may have shorter lifespans. A solution in which a component risks causing a fault in the circuit breaker is not satisfactory.

Document U.S. Pat. No. 5,159,522 relates to an electric clutch also including two coils. One of said coils actuates the clutch and the other holds it in its actuated state.

In an embodiment, a first input terminal and a first transistor power a first coil, while a second input terminal and a second transistor power both coils.

Transposing the teaching of that document for use in controlling electrical disconnection equipment, such as a circuit breaker, does not give rise to any drawback linked to the risk of a transistor failing. However, that solution is more complex and requires in particular two separate power supplies.

Document JP 2009/302358 discloses a circuit in which a coil is powered via a transistor and a capacitor in a first stage. In a second stage, the transistor is switched off and the current flowing in the coil is limited by a resistance element in series with the coil.

That type of circuit cannot be transposed for use in controlling a circuit breaker. For a circuit breaker, the current that must be broken in the activation circuit must be less than 4 amps (A) (DC), according to IEC standard 622271-1, § 5.4.4.5.4. That implies that, for a given voltage, some minimum resistance value is necessary. By way of example, for 110 volts (V) and 4 A, the sum of the resistances of the coil and of the resistance element must be at least 27.5 ohm (Ω).

In addition, the dead time of the mechanism should be short, typically less than 300 ms in order to comply with the operating cycle set out in IEC standard 62271.100, § 4.104.

That implies that the intrinsic resistance of the coil should be low, typically 4Ω. Thus, the resistance of the resistance element is at least 23.5Ω.

Those values have two consequences: the energy dissipated by the resistance element is six times greater than that dissipated by the coil, which is not desirable. Further, the coil needs to have a very small number of turns in order to have very low intrinsic resistance. A current of 4A flowing in said coil would not create sufficient magnetic flux for actuating the movable portions into their actuated positions.

SUMMARY OF THE INVENTION

The invention aims to resolve the problems of the prior art by providing an actuator circuit for actuating a circuit breaker controller, the circuit being characterized in that it comprises two branches in parallel between two terminals, and in that

- the first branch includes only a first coil; and
- the second branch includes a second coil having impedance that is lower than the first, in series with a switch controlled by a switch circuit.

By means of the invention, the action time of the actuator circuit is reduced and remains compatible with the speed requirements of a circuit breaker.

The first branch has a function of providing redundancy. If the second branch becomes inoperative, e.g. because of the failure of a component, then the first branch ensures the actuation function of the controller. Thus, failure of a component does not prevent the device from operating. Since the first coil has impedance that is greater than the second, the current flowing in the first coil remains low relative to the current in the second coil and may be broken by an auxiliary switch.

According to a preferred characteristic, the switch circuit is adapted to limit the strength of the current flowing in the second coil and to open the second branch after a predetermined time period, after a potential difference has been applied between the two terminals.

Thus, the current to be broken remains at a value that is less than 4A (DC), and complies with the conditions of IEC standard 622271-1.

According to a preferred characteristic the switch includes a component selected from a field-effect transistor, an NPN junction transistor, a thyristor, and a mechanical relay.

These components contribute to obtaining a short action time for the actuator circuit.

According to a preferred characteristic, the first and the second coils are wound around a single core. Thus, induced currents are created, in particular a current in the first coil when the current is broken in the second coil, which makes it possible to ensure the plunger performs a movement that is complete.

The invention also provides a circuit breaker controller including an actuator circuit as described above. It may be a spring controller.

The invention further provides a circuit breaker including a controller provided with an actuator circuit as described above.

The controller and the circuit breaker present advantages analogous to those exposed above.

BRIEF DESCRIPTION OF THE DRAWINGS

Other characteristics and advantages appear on reading about a preferred embodiment described by way of non-limiting example, and with reference to the figures in which.

DETAILED DESCRIPTION OF PARTICULAR EMBODIMENTS

Figure 1:
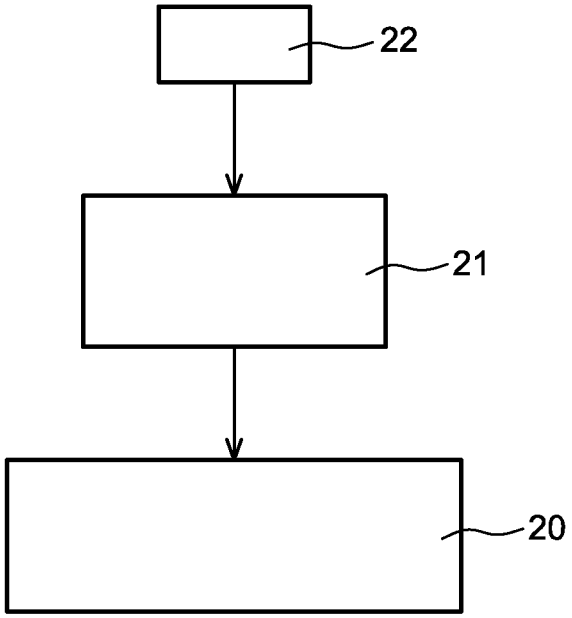
FIG. 1 is a diagram showing a circuit breaker fitted with a spring controller provided with an actuator circuit of the invention.

With reference to FIG. 1, a medium- or high-voltage circuit breaker 20 includes a spring controller 21 that supplies the energy and torque necessary for moving the contacts of the circuit breaker.

The circuit breaker 20 and the controller 21 are conventional except concerning an actuator circuit 22 that drives the controller 11. The circuit breaker and the controller are not described in detail here. The actuator circuit is described in detail below.

Figure 2:
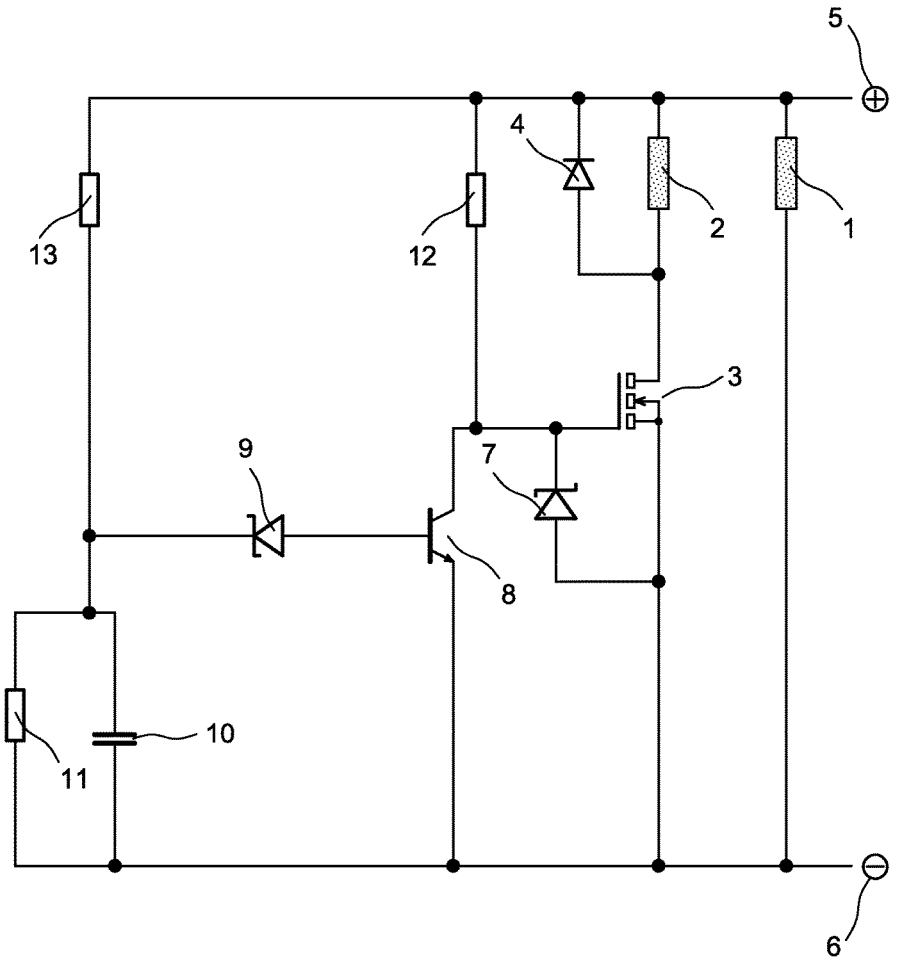
FIG. 2 shows the actuator circuit of the invention.

With reference to FIG. 2, the actuator circuit of the invention comprises two branches in parallel between two terminals 5 and 6 to which a potential difference may be applied in order to make the actuator circuit operate.

The first branch includes only one coil 1. By way of example, the coil 1 comprises 1000 turns and presents impedance of 35Ω. This branch has a function of providing redundancy. If the second branch becomes inoperative, e.g. because of the failure of a component, then the first branch ensures the actuation function of the spring controller. It is then in a mode of operation known as "degraded operation mode".

The second branch comprises a coil 2 and other components that are described below. By way of example, the coil 2 comprises 363 turns and presents an impedance of 3.55Ω. Naturally, other impedance values may be selected for the coils 1 and 2, provided that the impedance of the coil 1 is greater than that of the coil 2. The second branch provides the "normal" mode of operation.

Because of the difference in impedances, the operation in degraded mode (first branch) will thus be somewhat slower than in normal mode (second branch). By way of example, values measured on a prototype are 3.2 ms in normal mode and 5.5 ms in degraded mode.

In an embodiment, the coils 1 and 2 are both formed by winding around a single core.

The second branch is described below. From the terminal 5, the coil 2 is connected in series with a switch that is capable of opening the second branch. The switch is connected to the terminal 6. In a preferred embodiment, the switch mainly comprises a transistor 3. The transistor 3 is a field-effect transistor, e.g. of the metal-oxide-semiconductor field-effect transistor (MOSFET) type. The drain of the transistor 3 is connected to the coil 2, and the source of the transistor 3 is connected to the terminal 6. Other types of components may be used as a switch, in particular an NPN junction transistor, a thyristor, or a mechanical relay.

The transistor 3 makes it possible to limit the strength of the current flowing in the coil 2 to a value that makes it possible to break the current using an auxiliary switch. As mentioned above, the breaking capacity of an auxiliary switch is limited to a maximum current of 4A. With a coil 2 having impedance of 3.55Ω, and in the absence of the transistor 3 limiting the current, if a voltage is applied to terminals 5 and 6, situated at the respective ends of the two branches, that would lead to a current of 31A in the coil 2. Since this value is much greater than the maximum permissible limit of 4A, it is the transistor 3 that limits the current flowing in the coil 2.

A diode 4 is connected parallel to the coil 2. The anode of the diode 4 is connected to the drain of the transistor 3 and the cathode of the diode 4 is connected to the terminal 5. The diode 4 limits the effects of the overvoltage that appears when the second branch is opened by the transistor 3.

The transistor 3 is controlled by a control circuit, or switch circuit, that comprises a bipolar transistor 8, having its collector connected to the gate of the transistor 3.

The collector of the transistor 8 is also connected to one terminal of a resistor 12 having its other terminal connected to the terminal 5. The emitter of the transistor 8 is connected to the terminal 6. By way of example, the resistor 12 has a resistance of 56 kilohms (kΩ).

The base of the transistor 8 is connected to the anode of a Zener diode 9 having its cathode connected firstly to a parallel-connected capacitor 10 and resistor 11. The capacitor 10 and the resistor 11 are connected to the terminal 6. By way of example, the capacitor 10 has a capacitance of 0.1 microfarads (μF) and the resistor 11 has a resistance of 56 kΩ.

The cathode of the Zener diode 9 is connected secondly to a resistor 13, itself connected to the terminal 5. By way of example, the resistor 13 has a resistance of 200 kΩ.

The switch circuit operates as follows.

As soon as a potential difference is applied to the terminals 5 and 6, a current flows in the second branch and therefore in the coil 2, and the capacitor 10 is charged via the resistor 13. When the voltage at the terminals of the capacitor reach a certain value, e.g. 10.7 V with the previously-given numerical values, a current flows in the transistor 8, from its emitter to its base.

Because of the resistor 12, the electric potential of the collector of the transistor 8 and of the gate of the transistor 3 then falls.

The transistor 3 then opens the second branch, to such an extent that the current flowing in the coil 2 is broken, after about 2 ms.

It should be observed that because the impedance of the coil 1 is higher than that of the coil 2, the current that flows in the coil 1 always remains low enough to be able to be broken by an auxiliary switch.

As mentioned above, the coils 1 and 2 are preferably wound on the same core. That creates induced currents. When the transistor 3 breaks the flow of current in the coil 2, said coil induces a current in the coil 1. This induced current may serve to maintain the magnetic field necessary for moving the plunger of the mechanism. The current in the coil 2 is broken, for example, after 2 ms. This time period may be too short for the plunger to reach its actuated final position. The current induced in the coil 1 thus makes it possible for the plunger to finish its stroke.

In a variant, the control circuit of the transistor 3 is a resistance-capacitance (RC) circuit. In this event, a capacitor is connected between the terminal 5 and the gate of the transistor 3, and a resistor is connected between the terminal 6 and the gate of the transistor 3. Their resistance and capacitance are selected so that the RC time-constant is equal to a determined value, e.g. 2 ms.

It should be observed that the invention not only finds application in a gas-insulated substation (GIS), but also in other types of connection equipment, e.g. air-insulated switchgear, or dead-tank oil circuit-breakers, for use indoors or outdoors.

The invention claimed is:

1. An actuator circuit for actuating a circuit breaker controller, the circuit comprising:

two branches in parallel between two terminals, wherein:

the first branch includes only a first coil; and the second branch includes a second coil having impedance that is lower than the first coil, in series with a switch controlled by a switch circuit and a diode connected in parallel to the second coil, wherein the switch circuit comprises a bipolar transistor, wherein a collector of the bipolar transistor is connected to one terminal of a first resistor, another terminal of the first resistor is connected to a first terminal of the two terminals, an emitter of the bipolar transistor is connected to a second terminal of the two terminals, and a base of the bipolar transistor is connected to an anode of a Zener diode, wherein a cathode of the Zener diode is connected to a capacitor and a second resistor connected in parallel to each other and to the second terminal, and wherein the cathode of the Zener diode is connected to a third resistor connected to the first terminal.

2. An actuator circuit according to claim 1, wherein:

the switch circuit is adapted to limit the strength of the current flowing in the second coil-and to open the second branch after a predetermined time period, after a potential difference has been applied between the two terminals.

3. An actuator circuit according to claim 1 wherein:

the switch includes a component selected from a field-effect transistor, an NPN junction transistor, a thyristor, and a mechanical relay.

4. An actuator circuit according to claim 3, wherein:

the switch is a field-effect transistor, wherein the collector of the bipolar transistor is connected to a gate of the field-effect transistor.

5. An actuator circuit according to claim 1 wherein: the first and the second coils are wound around a single core.

6. An actuator circuit according to claim 1, wherein an anode of the diode is connected to the switch and a cathode of the diode is connected to one of the terminals.

7. A circuit breaker controller comprising an actuator circuit having two branches in parallel between two terminals wherein:

the first branch includes only a first coil; and the second branch includes a second coil having impedance that is lower than the first coil, in series with a switch controlled by a switch circuit and a diode connected in parallel to the second coil, wherein an anode of the diode is connected to the switch and a cathode of the diode is connected to one of the terminals, wherein the switch circuit comprises a bipolar transistor, wherein a collector of the bipolar transistor is connected to one terminal of a first resistor, another terminal of the first resistor is connected to a first terminal of the two terminals, an emitter of the bipolar transistor is connected to a second terminal of the two terminals, and a base of the bipolar transistor is connected to an anode of a Zener diode, wherein a cathode of the Zener diode is connected to a capacitor and a second resistor connected in parallel to each other and to the second terminal, and wherein the cathode of the Zener diode is connected to a third resistor connected to the first terminal.

8. A circuit breaker comprising a controller provided with an actuator circuit having two branches in parallel between two terminals wherein:

the first branch includes only a first coil; and the second branch includes a second coil having impedance that is lower than the first coil, in series with a switch controlled by a switch circuit and a diode connected in parallel to the second coil, wherein an anode of the diode is connected to the switch and a cathode of the diode is connected to one of the terminals, wherein the switch circuit comprises a bipolar transistor, wherein a collector of the bipolar transistor is connected to one terminal of a first resistor, another terminal of the first resistor is connected to a first terminal of the two terminals, an emitter of the bipolar transistor is connected to a second terminal of the two terminals, and a base of the bipolar transistor is connected to an anode of a Zener diode, wherein a cathode of the Zener diode is connected to a capacitor and a second resistor connected in parallel to each other and to the second terminal, and wherein the cathode of the Zener diode is connected to a third resistor connected to the first terminal.

* * * * *